US008095056B2

(12) United States Patent
Mikajiri et al.

(10) Patent No.: US 8,095,056 B2
(45) Date of Patent: Jan. 10, 2012

(54) PRESSURE-APPLYING DEVICE, TRANSFER DEVICE, AND IMAGE FORMING APPARATUS

(75) Inventors: Susumu Mikajiri, Tokyo (JP); Junichi Kawase, Kanagawa (JP); Junji Shirakawa, Ibaraki-Pref (JP); Makoto Nakura, Ibaraki-Pref (JP)

(73) Assignee: Ricoh Company, Ltd., Tokyo (JP)

( * ) Notice: Subject to any disclaimer, the term of this patent is extended or adjusted under 35 U.S.C. 154(b) by 692 days.

(21) Appl. No.: 12/202,663

(22) Filed: Sep. 2, 2008

(65) Prior Publication Data

US 2009/0067892 A1 Mar. 12, 2009

(30) Foreign Application Priority Data

Sep. 7, 2007 (JP) ..... 2007-233121

(51) Int. Cl.
*G03G 15/20* (2006.01)

(52) U.S. Cl. ..... 399/313

(58) Field of Classification Search ..... 399/313, 399/167, 121, 297, 345
See application file for complete search history.

(56) References Cited

U.S. PATENT DOCUMENTS

| | | | | |
|---|---|---|---|---|
| 4,914,479 | A * | 4/1990 | Ogura et al. | 399/161 |
| 2002/0164177 | A1* | 11/2002 | Watanabe et al. | 399/237 |
| 2008/0138115 | A1* | 6/2008 | Chadani et al. | 399/167 |
| 2008/0226321 | A1* | 9/2008 | Kuwabara et al. | 399/66 |

FOREIGN PATENT DOCUMENTS

| | | |
|---|---|---|
| JP | 2000-122445 | 4/2000 |
| JP | 2005-301216 | 10/2005 |
| JP | 3789292 | 4/2006 |

* cited by examiner

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

A pressure-applying device includes a swingable unit body, a roller, an opposing member, a pressure-applying unit, and a drive-force transmitting unit. A swinging center of the unit body is set at a position distinct from a rotation center of the drive-force transmitting unit. A direction of action of driving force of the driving unit substantially coincides with a line joining the swinging center and a point at which pressure application force is applied by the pressure-applying unit. A direction of action of the pressure application force is substantially orthogonal to the direction of action of the driving force.

11 Claims, 7 Drawing Sheets

PRESSURE-APPLYING DEVICE, TRANSFER DEVICE, AND IMAGE FORMING APPARATUS

CROSS-REFERENCE TO RELATED APPLICATIONS

The present application claims priority to and incorporates by reference the entire contents of Japanese priority document 2007-233121 filed in Japan on Sep. 7, 2007.

BACKGROUND OF THE INVENTION

1. Field of the Invention

The present invention relates to a technology for controlling pressure application force of a pressure-applying device for use in an image forming apparatus.

2. Description of the Related Art

Image forming apparatuses that support color image output, such as color copiers and color printers, are widely used. Such color image forming apparatuses can be single drum type or tandem type. The single drum type image forming apparatus has one photosensitive member functioning as an image-carrying member, and a plurality of developing devices of different toner colors disposed around the photosensitive member. The toner of each color from each of the developing devices is made to adhere to the photosensitive member to form a composite toner image. The composite toner image is transferred from the photosensitive member to a transfer sheet functioning as a recording medium. On the other hand, the tandem-type image forming apparatus has a plurality of photosensitive members arranged in a row in a conveyance direction of a transfer sheet, with a separate developing device for each toner color disposed in the vicinity of each photosensitive member. The individual toner image of each color is formed on the respective photosensitive member, and each toner image is sequentially superimposed onto an intermediate transfer unit by primary transfer, so that a composite image is formed. The composite image is eventually transferred to the transfer sheet by secondary transfer, so that a full color image is obtained.

The single drum type image forming apparatus is compact and less expensive compared to the tandem-type image forming apparatus. However, it is difficult to increase the speed of image formation in the single drum type image forming apparatus because image formation has to be repeated several times to obtain a full color image. On the other hand, the tandem-type image forming apparatus is less compact and more expensive but has the advantage of fast operation speed of image formation.

Generally, color image forming apparatuses use toners of four different colors and therefore image formation has to be repeated as much as four times in the single drum type image forming apparatus to obtain a full color image.

In the tandem-type image forming apparatus, the transfer of the toner images formed on the photosensitive members can be by a direct transfer method or an intermediate transfer method. Explanation about the direct transfer method is given with reference to FIG. 11. Four transfer units 91 are provided for each of four photosensitive members 90 corresponding to each toner color. Each of the transfer units 91 sequentially transfers the image formed on each of the photosensitive members 90 to a transfer sheet S conveyed by an endless transfer sheet conveying belt 92 that is driven to move in a predetermined direction at a predetermined speed by a belt driving device or a transfer sheet driving system. Explanation about the intermediate transfer method is given with reference to FIG. 12. Each of the transfer units 91 sequentially transfers by primary transfer an image formed on each of the photosensitive members 90 to an endless intermediate transfer belt 93, so that a composite color image is obtained. The intermediate transfer belt 93 functions as the intermediate transfer unit and is driven to move in a predetermined direction at a predetermined speed by the belt driving device or the transfer sheet driving system. A secondary transfer unit 94 transfers by secondary transfer the composite image on the intermediate transfer belt 93 at once to the transfer sheet S. The intermediate transfer unit can be in the form of a roller instead of a belt.

When a roller is employed as the transfer units 91 or the secondary transfer unit 94 in a single drum type image forming apparatus, to prevent density unevenness during image transfer, pressure application force to the transfer unit along its axial direction should be uniform. A spring can be provided as a pressure-applying member at either end of the shaft of the transfer unit to apply pressure to the two ends of the transfer unit. However, pressure application force is likely to be unstable by this method.

Japanese Patent Application Laid-open No. 2000-122445 discloses a technology for controlling pressure application of a pressure-applying member provided on a drive-force receiving side of a transfer unit. Specifically, the pressure application force is set higher by a force component of driving force that acts in a normal direction to the teeth surface of drive-force transmitting gears, in an expansion-contraction direction of a spring. Therefore, it is possible to compensate for decrease of the pressure application force on the drive-force receiving side caused by the component force in an expansion-contraction direction of the spring. Thus, a uniform pressure can be applied to the transfer unit along its axial direction.

However, some of the disadvantages of the conventional technology are increased number of components and difficulty in determining an optimum load value for the spring. It is difficult to determine an optimum load value for the spring due to the following reason. The driving torque is constant when there is no transfer sheet S between the roller-type transfer unit (hereinafter, "transfer roller") and an opposing roller in pressure contact with the transfer roller and when there are no variations in the component (such as roller diameter and installation position). However, the driving torque is not constant if a thick paper is used as a transfer sheet or if there are variations in the component precision. In other words, during operation, the driving force acting in the normal direction of the teeth surface of the drive-force transmitting gear varies. Therefore, stable pressure to the transfer unit along the axial direction cannot be achieved by merely changing the load value of the spring. The inability to maintain constant pressure application force along the axial direction between the rollers results in image density unevenness due to faulty transfer.

The mechanism described above is explained with reference to a pressure-applying device employing a conventional drive-force transmission method. FIG. 13 is a schematic diagram of the pressure-applying device employing the conventional drive-force transmission method. A reference numeral 95 in FIG. 13 denotes a secondary transfer roller and A reference number 96 denotes an opposing roller. The secondary transfer roller 95 is rotatably supported by a transfer unit (not shown). The transfer unit is rotatably supported at a rotation center AO in the main body of the image forming apparatus, is in pressure contact with the opposing roller 96, and is biased upwards by a pressure-applying spring (not shown) disposed at a pressure application point A1. A gear 97 is provided coaxially with the secondary transfer roller 95. A first idle gear 98A is engaged with the gear 97, a second idle gear 98B is in turn engaged with the first idle gear 98A, and a driving gear 99 is engaged with the second idle gear 98B. The driving force from a driving motor (not shown) is conveyed to the secondary transfer roller 95 via the gear 97, the first idle gear 98A, the second idle gear 98B, and the driving gear 99, causing the secondary transfer roller 95 to rotate.

If F1 is reactive force at the driving-gear end, F2 is reactive force at the non-driving-gear end, T is driving force, W is self-weight of the transfer unit, and P is pressure application force of the pressure-applying spring, the pressure-applying mechanism model can be given by the following expression based on the principle of moment equilibrium.

At the driving-gear end, $$F1\times\cos\theta1\times L1=P\times\sin\theta2-W\times L3-T\times L4$$

Therefore, $$F1=(P\times\sin\theta2\times L2-W\times L3-T\times L4)/(L1\times\cos\theta1) \quad (1)$$

At the non-driving-gear end, $$F2\times\cos\theta1\times L1=P\times\sin\theta2\times L2-W\times L3$$

Therefore, $F2=(P\times\sin\theta2\times L2-W\times L3)/(L1\times\cos\theta1)$ (2)

Thus, it can be surmised from expression (1) that the driving force has an effect of weakening the reactive force F1. The variation in the reactive force F1 can be reduced by increasing the load of the pressure-applying spring to the extent to which the reactive force F1 is weakened by the driving force T. However, it is difficult to maintain the reactive force F1 constant during operation because of the variation of the driving force T due to variation in the component specification or the presence of the transfer sheet S between the rollers.

SUMMARY OF THE INVENTION

It is an object of the present invention to at least partially solve the problems in the conventional technology.

According to an aspect of the present invention, there is provided a pressure-applying device for use in an apparatus that includes a unit body swingably supported by an apparatus body; a roller rotatably supported by the unit body; a driving unit that applies driving force via a drive-force transmitting unit to rotate the roller; an opposing member arranged opposite to the roller; and a pressure-applying unit that applies a bias force that causes the unit body to swing and applies pressure application force that causes the roller to come in pressure contact with the opposing member, wherein a swinging center of the unit body is set at a position distinct from a rotation center of the drive-force transmitting unit, a direction of action of the driving force substantially coincides with a line joining the swinging center and a pressure application point at which the pressure application force is applied, and a direction of action of the pressure application force is substantially orthogonal to the direction of action of the driving force.

According to another aspect of the present invention, there is provided a transfer device that includes the above pressure-applying device.

According to still another aspect of the present invention, there is provided an image forming apparatus that includes the above pressure-applying device.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
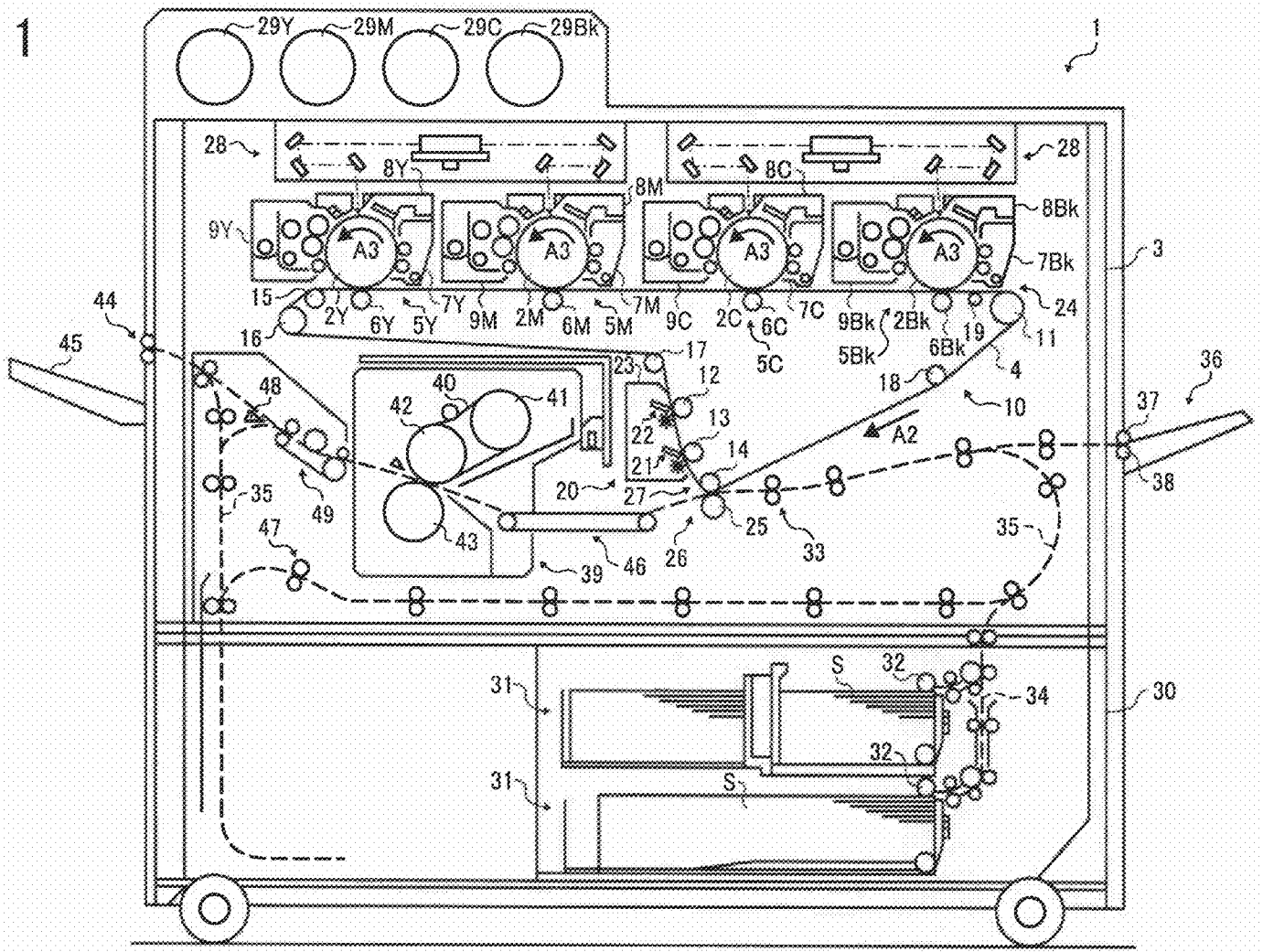
FIG. 1 is a schematic diagram of an image forming apparatus having a pressure-applying device according to a first embodiment of the present invention.

Exemplary embodiments of the present invention are described in detail below with reference to the accompanying drawings. FIG. 1 is a schematic diagram of an image forming apparatus 1 having a pressure-applying device according to a first embodiment of the present invention is adapted. The image forming apparatus 1 is a tandem-type image forming apparatus having photosensitive drums 2Y, 2M, 2C, and 2Bk arranged in a parallel manner and capable of forming images in yellow, magenta, cyan, and black, respectively. The photosensitive drums 2Y, 2M, 2C, and 2Bk are rotatably supported in a frame (not shown) in an apparatus body 3 of the image forming apparatus 1. The photosensitive drums 2Y, 2M, 2C, and 2Bk are arranged in the mentioned order in a rotation direction of a transfer belt 4 starting from a position upstream of the clockwise direction indicated by an arrow A2 shown in FIG. 1. The suffixes Y, M, C, and Bk in the reference symbols 2Y, 2M, 2C, and 2Bk indicate that the respective components are corresponding to the toner colors yellow, magenta, cyan, and black. The photosensitive drums 2Y, 2M, 2C, and 2Bk are, respectively, provided in image forming units 5Y, 5M, 5C, and 5Bk for forming images of yellow, magenta, cyan, and black. Each of the photosensitive drums 2Y, 2M, 2C, and 2Bk is disposed on an image forming side of the transfer belt 4, which is the external surface side of the transfer belt 4.

All the image forming units 5Y, 5M, 5C, and 5Bk are structurally identical. The image forming units 5Y, 5M, 5C, and 5Bk includes primary transfer rollers 6Y, 6M, 6C, and 6Bk, cleaning devices 7Y, 7M, 7C, and 7Bk, charging devices 8Y, 8M, 8C, and 8Bk, and developing devices 9Y, 9M, 9C, and 9Bk, respectively, which are disposed sequentially around each of the photosensitive drums 2Y, 2M, 2C, and 2Bk in a rotation direction, that is, in the counter-clockwise direction indicated by an arrow A3 in FIG. 1.

A transfer belt unit 10, which includes the transfer belt 4 functioning as an intermediate transfer unit, is disposed substantially centrally in the apparatus body 3. The transfer belt unit 10 includes the transfer belt 4, the primary transfer rollers 6Y, 6M, 6C, and 6Bk, a drive roller 11, cleaning-device facing rollers 12 and 13, a supporting roller 14 functioning as an opposing member, supporting rollers 15 to 19, a belt cleaning device 20, a driving unit (not shown) that drives the drive roller 11 to rotate, a power source (not shown) that impresses a primary transfer bias to the primary transfer rollers 6Y, 6M, 6C, and 6Bk, and a bias control unit (not shown).

The cleaning-device facing rollers 12 and 13 and the supporting rollers 14 to 19 are driven to rotate as the transfer belt 4 rotates because of the rotating drive roller 11. Each of the primary transfer rollers 6Y, 6M, 6C, and 6Bk forms a respective primary transfer nip by pushing against each of the photosensitive drums 2Y, 2M, 2C, and 2Bk from the inner surface of the transfer belt 4. These primary transfer nips are formed in the portion of the transfer belt 4 that lies between the supporting rollers 15 and 19. The supporting rollers 15 and 19 serve the function of stabilizing the primary transfer nips. A primary transfer electric field is formed at each of the primary transfer nips due to the primary transfer bias. The primary transfer electric field and the nip pressure bring about the primary transfer of the toner image of each color formed on the photosensitive drums 2Y, 2M, 2C, and 2Bk to the transfer belt 4. When no color other than black is to be used for image formation, the supporting rollers 15 and 16 along with the primary transfer rollers 6Y, 6M, and 6C are shifted downwards, thus causing the transfer belt 4 to shift away from the photosensitive drums 2Y, 2M, and 2C.

The belt cleaning device 20 is disposed downstream of the supporting roller 14 in the direction of the arrow A2, and is disposed to the left of the cleaning-device facing rollers 12 and 13 against the transfer belt 4. The belt cleaning device 20 includes a casing 23 that houses a cleaning blade 21 and a lubricant applying device 22. The cleaning blade 21 cleans the transfer belt 4 at the position where the cleaning-device facing roller 13 is disposed. The lubricant applying device 22 is disposed at the position opposed to the cleaning-device facing roller 12. The belt cleaning device 20 cleans the transfer belt 4 by removing residual toner on the transfer belt 4 by the cleaning blade 21.

The transfer belt 4 is provided to be movable in the direction of the arrow A2 while abutting against the photosensitive drums 2Y, 2M, 2C, and 2Bk. The toner images formed on the photosensitive drums 2Y, 2M, 2C, and 2Bk are superimposed on the transfer belt 4, and subsequently, the image on the transfer belt 4 is transferred in entirety all at once to the transfer sheet S. Portions of the upper side of the transfer belt 4 face the photosensitive drums 2Y, 2M, 2C, and 2Bk, and form primary transfer points 24 at which the toner image of each color from each of the photosensitive drums 2Y, 2M, 2C, and 2Bk is transferred to the transfer belt 4. As the transfer belt 4 moves in the direction of the arrow A2, the toner images from the photosensitive drums 2Y, 2M, 2C, and 2Bk are made to be superimposed at the same position on the transfer belt 4 by appropriately staggering the timing of bias application to the primary transfer rollers 6Y, 6M, 6C, and 6Bk from upstream side to downstream side in the direction of the arrow A2.

The transfer belt 4 includes a base layer made of a material that is stretch-resistant and a coating layer of a smooth material covering the base layer. Materials such as fluororesin, polyvinyl dichloride (PVD) sheet, or polyimide resin can be used for the base layer. Fluororesin can be used for the coating layer. Along the two edges of the transfer belt 4 guide members (not shown) are provided that prevent the transfer belt 4 rotating in the direction of the arrow A2 from becoming perpendicular to the surface of the transfer sheet S. Materials such as urethane rubber and silicone rubber can be used for the guide members.

A secondary transfer unit 26 is disposed opposed to the supporting roller 14 across the transfer belt 4. The secondary transfer unit 26 serves as a transfer unit and includes or acts as the pressure-applying device that includes a secondary transfer roller 25. The secondary transfer roller 25 is in pressure contact with the supporting roller 14 across the transfer belt 4, forming a secondary transfer point 27 at the point of pressure contact. The supporting roller 16 functions as a tension roller and gives the transfer belt 4 a predetermined tension. A secondary transfer electric field is formed due to a secondary transfer bias at the secondary transfer point 27. Due to the secondary transfer electric field and the nip pressure, the toner images formed on the transfer belt 4 are transferred to the transfer sheet S by secondary transfer. Owing to its location, the supporting roller 14 also functions as a secondary-transfer-unit facing roller. The secondary transfer unit 26 will be described in detail later.

Two optical scanning devices 28 that function as optical writing units and form electrostatic latent images on the photosensitive drums 2Y, 2M, 2C, and 2Bk are disposed above the image forming units 5Y, 5M, 5C, and 5Bk. Toner bottles 29Y, 29M, 29C, and 29Bk containing, respectively, yellow toner, magenta toner, cyan toner, and black toner are disposed above one of the optical scanning devices 28. The predetermined quantity of the toner of each color is conveyed via a toner conveying path (not shown) to each of the developing devices 9Y, 9M, 9C, and 9Bk.

A paper feeding table 30 is provided below the apparatus body 3. The paper feeding table 30 includes a plurality of paper feeding devices 31 in which are stacked transfer sheets S to be conveyed to the secondary transfer point 27. Each of the paper feeding devices 31 contains a stacked bundle of transfer sheets S. In the present embodiment, the two paper feeding devices 31 are arranged one on top of the other. A paper feeding roller 32 in pressure contact with the topmost transfer sheet S in each of the paper feeding devices 31 is driven to rotate in counter-clockwise direction in FIG. 1 at a predetermined timing, and thereby convey the topmost transfer sheet S towards the apparatus body 3.

A pair of registration rollers 33 and a sensor (not shown) are disposed to the right of the secondary transfer point 27. The pair of registration rollers 33 conveys the transfer sheet S that is fed from one of the paper feeding devices 31 to the secondary transfer point 27 at a predetermined timing that is in line with the timings at which the image forming units 5Y, 5M, 5C, and 5Bk form the respective toner images. The sensor detects when the leading edge of the transfer sheet S reaches the pair of registration rollers 33. Upon reaching the pair of registration rollers 33 via a paper conveying path 34 within the paper feeding table 30, the transfer sheet S is held between the pair of registration rollers 33. In FIG. 1, a plurality of conveying rollers without reference numerals are shown inside the apparatus body 3. All of these conveying rollers form a paper conveying path 35, shown by a dashed line in FIG. 1, within the apparatus body 3 and play a role in conveying the transfer sheet S.

A manual tray 36 is disposed to the right of the apparatus body 3 for manual paper feeding. A paper feeding roller 37 and a paper separating roller 38 are disposed downstream of the manual tray 36 in the paper conveyance direction. The paper separating roller 38 is disposed opposed to the paper feeding roller 37 and picks up the transfer sheets S fed by the paper feeding roller 37 one sheet at a time.

A fixing device 39 that fixes the toner images on the transfer sheet S is disposed to the left of the secondary transfer point 27. The fixing device 39 includes an endless fixing belt 40, a heat-applying roller 41 that contains a heat source, a fixing roller 42, and a pressure-applying roller 43 that is in pressure contact with the fixing roller 42. The fixing belt 40 is wound around the heat-applying roller 41 and the fixing roller 42. The fixing device 39 fixes the toner images on the transfer sheet S by heat and pressure application by holding the transfer sheet S at a fixing point formed by a pressure application point between the portion of the fixing belt 40, which is extended on the fixing roller 42, and the pressure-applying roller 43.

Paper discharge rollers 44 and a discharge tray 45 are disposed to the left of the fixing device 39. The paper discharge rollers 44 discharge the transfer sheet S with a fixed image outside the apparatus body 3. The discharge tray 45 receives the transfer sheets S discharged by the paper discharge rollers 44. A conveying device 46 in the form of a conveyor belt that conveys the transfer sheet S that has got past the secondary transfer point 27 to the fixing device 39 is provided between the secondary transfer point 27 and the fixing device 39. The conveying device 46 can be in the form of an immobile guide plate.

A paper reversing unit 47, a switching guide 48, and a paper conveying device 49 are disposed between the fixing device 39 and the paper discharge rollers 44. The paper reversing unit 47 reverses the transfer sheet S that has been passed the fixing device 39 and conveys it once again towards the pair of registration rollers 33. The switching guide 48 guides the transfer sheet S that has been passed the fixing device 39 either towards the paper discharge rollers 44 or the paper reversing unit 47. The paper conveying device 49 conveys the transfer sheet S that has been passed the fixing device 39 towards the switching guide 48. The apparatus body 3 also includes many other parts (not shown) such as a power source and a bias control unit that impress a secondary transfer bias to the secondary transfer roller 25, a driving unit for driving each of the photosensitive drums 2Y, 2M, 2C, and 2Bk, and a control unit that controls the overall functioning of the image forming apparatus 1.

Upon receipt of a signal instructing the image forming apparatus 1 to form a color image, the drive roller 11 rotates to drive the transfer belt 4, the cleaning-device facing rollers 12 and 13, and the supporting rollers 14 to 19 to rotate. The photosensitive drums 2Y, 2M, 2C, and 2Bk also are driven to rotate in the direction of the arrow A3. As the photosensitive drums 2Y, 2M, 2C, and 2Bk rotate, the charging devices 8Y, 8M, 8C, and 8Bk uniformly charge the surface of the respective photosensitive drums 2Y, 2M, 2C, and 2Bk. The optical scanning devices 28 expose and scan the uniformly charged surfaces of the photosensitive drums 2Y, 2M, 2C, and 2Bk to form electrostatic latent images corresponding to the colors yellow, magenta, cyan, and black on the surfaces of the respective photosensitive drums 2Y, 2M, 2C, and 2Bk. The developing devices 9Y, 9M, 9C, and 9Bk convert the electrostatic latent images to visible single-color toner images of the respective colors on the corresponding photosensitive drums 2Y, 2M, 2C, and 2Bk. The primary transfer rollers 6Y, 6M, 6C, and 6Bk sequentially transfer the corresponding toner images on the same point on the transfer belt 4, thus forming a composite color image on the transfer belt 4.

One of the paper feeding devices 31 is selected according to the signal for color image formation received by the image forming apparatus 1, and the paper feeding roller 32 of the selected paper feeding device 31 starts rotating and picks up a single transfer sheet S and conveys it towards the paper conveying path 35. The transfer sheet S is kept held between the pair of registration rollers 33. If the transfer sheets S are stacked in the manual tray, the paper feeding roller 37 starts rotating to feed the transfer sheets S, and the paper separating roller separates and conveys one transfer sheet S towards the paper conveying path 35, where the transfer sheet S is kept held between the pair of registration rollers 33.

The rotation of the pair of registration rollers 33 is timed to match with the timing at which the superimposed composite color image formed on the transfer belt 4 reaches the secondary transfer point 27 due to the rotating transfer belt 4. At the secondary transfer point 27, the composite color image on the transfer belt 4 is transferred to the transfer sheet S by secondary transfer due to nip pressure and bias application. The conveying device 46 conveys the transfer sheet S with the composite color image to the fixing device 39. When the transfer sheet S transits the fixing point, the fixing device 39 fixes the composite color image by heat and pressure application.

The transfer sheet S with a fixed composite color image is conveyed via the paper conveying device 49, and depending on the position of the switching guide 48, to either the paper discharge rollers 44 and the discharge tray 45 or to the paper reversing unit 47 for image formation on the reverse side. The transfer sheet S that has been conveyed to the paper reversing unit 47 is eventually discharged to the discharge tray 45 with both of its surfaces bearing images.

The residual toner adhering to the surface of each of the photosensitive drums 2Y, 2M, 2C, and 2Bk after toner image transfer is removed by each of the cleaning devices 7Y, 7M, 7C, and 7Bk. The surfaces of the photosensitive drums 2Y, 2M, 2C, and 2Bk are once again uniformly charged by the charging devices 8Y, 8M, 8C, and 8Bk, respectively, in preparation for the next round of image formation. Once secondary transfer has taken place and the transfer belt 4 has passed the secondary transfer point 27, the surface of the transfer belt 4 is cleaned by the belt cleaning device 20 in preparation for the next round of image transfer.

Figure 2:
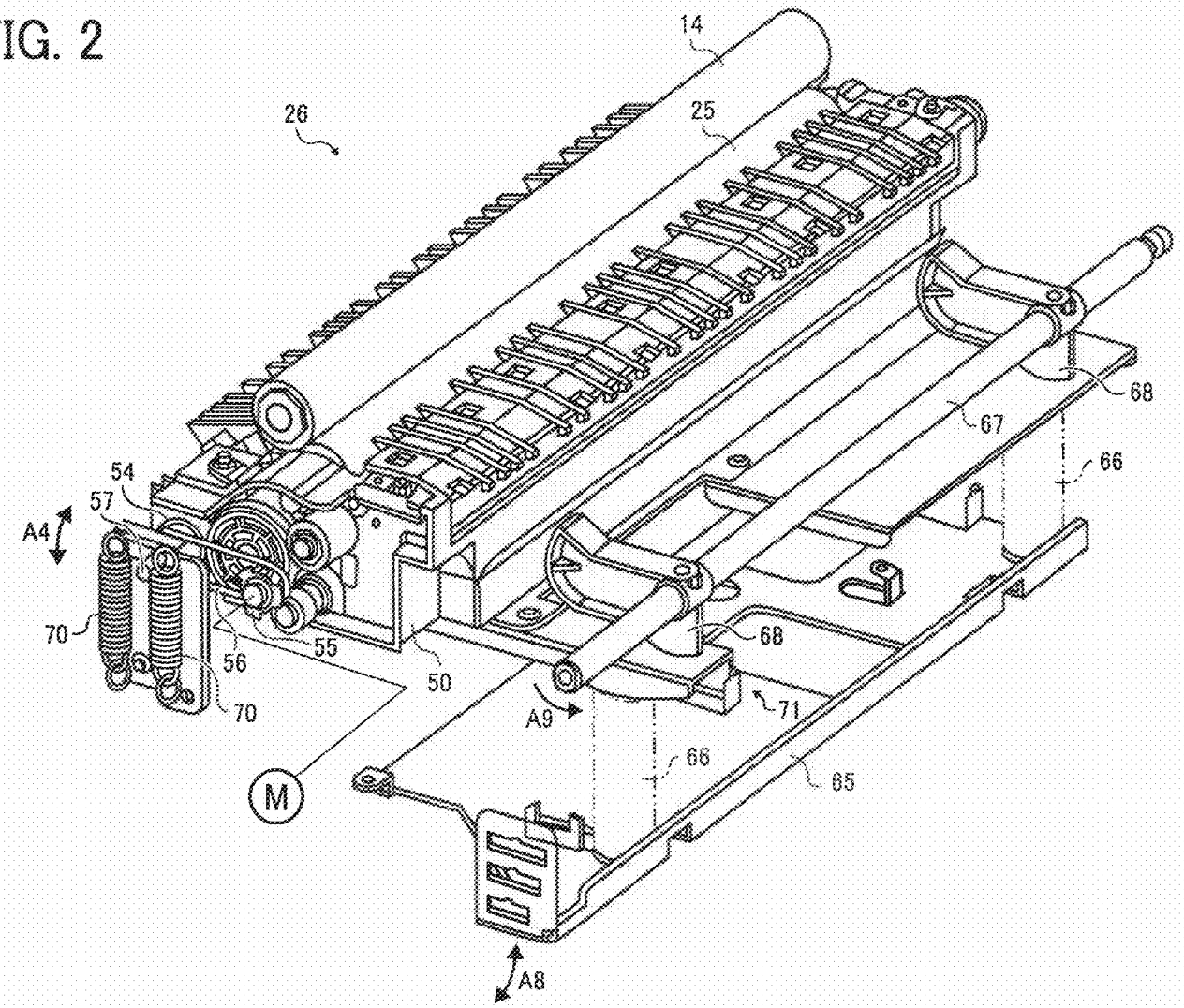
FIG. 2 is a perspective view of the pressure-applying device according shown in FIG. 1.

The secondary transfer unit 26, which is the salient feature of the present invention and which is an example of a pressure-applying device, is described below in detail. FIG. 2 is a perspective view of the secondary transfer unit 26. The secondary transfer roller 25 is rotatably supported by a unit body 50 and is driven to rotate by a driving unit described later. The secondary transfer roller 25 is in pressure contact with the supporting roller 14 across the transfer belt 4, which is not shown in FIG. 2.

Figure 3:
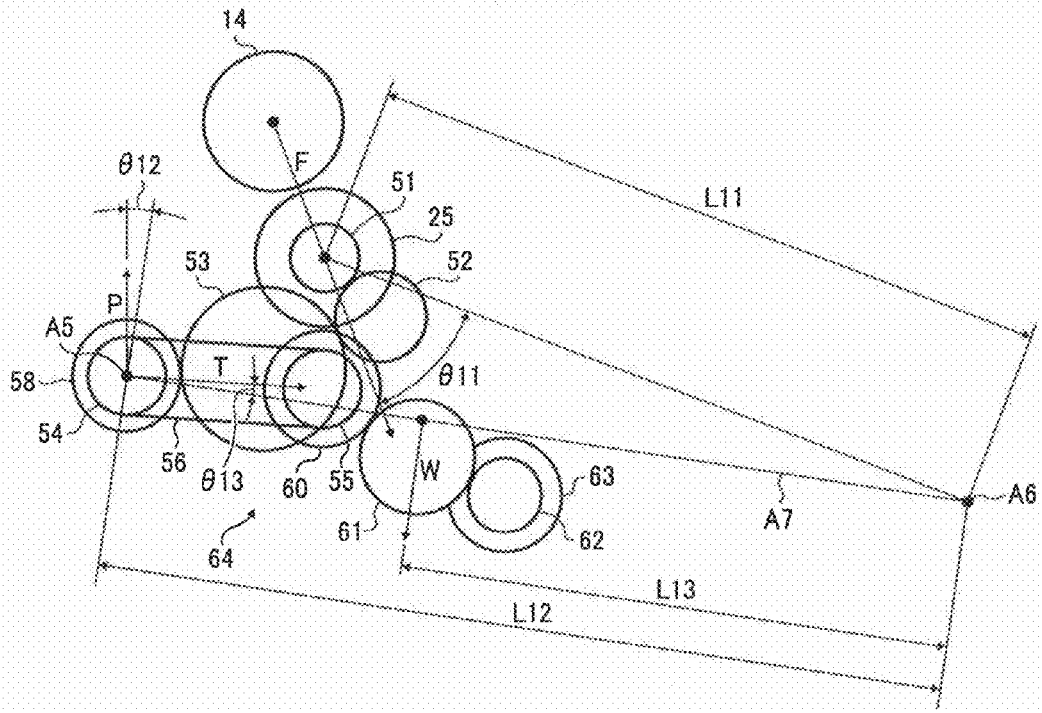
FIG. 3 is a schematic diagram of a drive-force transmission system of the pressure-applying device and a relation between moments that come into play in the drive-force transmission system.

FIG. 3 is a schematic diagram of a drive-force transmission system of the secondary transfer unit 26 and a relation between moments that come into play in the secondary transfer unit 26. A first gear 51 provided coaxially with the secondary transfer roller 25 is interlocked with a second gear 52 rotatably supported in the unit body 50. The second gear 52 is interlocked with a third gear 53 rotatably supported by the unit body 50. A first pulley 54 and a second pulley 55 are rotatably supported by the apparatus body 3. An endless belt 56 is wound around the first pulley 54 and the second pulley 55. A fourth gear 58 is interlocked with the third gear 53 and provided coaxially with a first spindle 57 (shown in FIGS. 2 and 4) of the first pulley 54. A fifth gear 60 is provided coaxially with a second spindle 59 (shown in FIG. 4) of the second pulley 55. The fifth gear 60 is interlocked with a sixth gear 61 rotatably supported in the apparatus body 3 by a bracket (not shown). The sixth gear 61 is interlocked with a driving gear 62 fitted to an output shaft of a motor 63 functioning as a driving unit and fitted in the apparatus body 3. In this configuration, the first gear 51, the second gear 52, the third gear 53, the first pulley 54, the second pulley 55, the endless belt 56, the fourth gear 58, the fifth gear 60, the sixth gear 61, and the driving gear 62 form a drive-force transmitting unit 64 that transmits the driving force of the motor 63 to the secondary transfer roller 25, thus driving the secondary transfer roller 25 to rotate.

Figure 4:
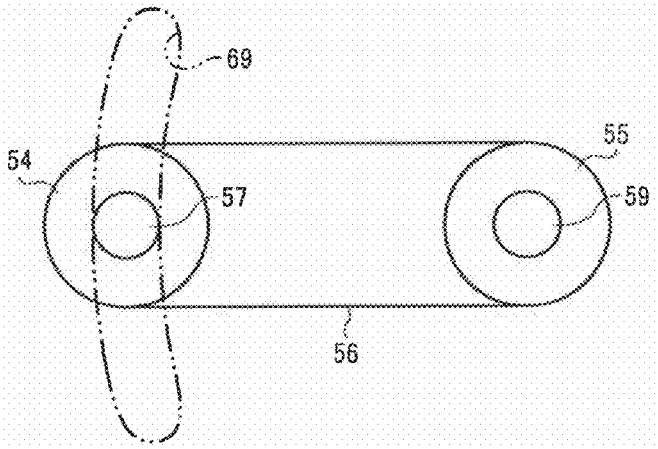
FIG. 4 is a drawing of a supporting mechanism that supports an endless belt according to the first embodiment.

The unit body 50 is biased upwards on an immovable member 65 provided in the apparatus body 3 by two compression springs 66 arranged on the immovable member 65. Two cams 68 fitted to a third spindle 67 rotatably supported by the immovable member 65 regulate the upward movement of the unit body 50. The two ends of the first spindle 57 engage in an elongated curved slot 69 shown in FIG. 4, provided on a side plate (not shown) on either side of the apparatus body 3. Thus, the unit body 50 is supported by the first spindle 57 to swing in the directions of a two-headed arrow A4 shown in FIG. 2 about the points where the unit body 50 is supported by the compression springs 66 and the cams 68. Four extension coil springs 70 (only two are shown in FIG. 2) that function as pressure-applying units are provided in the apparatus body 3. Upward bias force by the extension coil springs 70 on the first spindle 57 causes the secondary transfer roller 25 to be in pressure contact with the supporting roller 14.

In the example shown in FIG. 3, if F1 is reactive force at the driving-gear end, F2 is reactive force at the non-driving-gear end, T is driving force, W is self-weight of the secondary transfer unit 26, and P is pressure application force of the extension coil springs 70, the pressure-applying mechanism model can be given by the following expression based on the principle of moment equilibrium.

At the driving-gear end, $$F1\times\sin\theta11\times L11=P\times\cos\theta12\times L12-W\times L13+T\times\sin\theta13\times L12$$

Therefore, $$F1=\{(P\times\cos\theta12+T\times\sin\theta13)\times L12-W\times L13\}/(L11\times\sin\theta11)$$

At the non-driving-gear end, $$F2\times\sin\theta11\times L11=P\times\cos\theta12\times L12-W\times L13$$

Therefore, $$F2=(P\times\cos\theta12\times L12-W\times L13)/(L11\times\sin\theta11)$$

In the present embodiment, θ13 is 1.8°, and therefore sin θ13 would be sin 1.8°, which is 0.03. Thus, the effect of the driving force T on the reactive force F1 is extremely insignificant.

Figure 5:
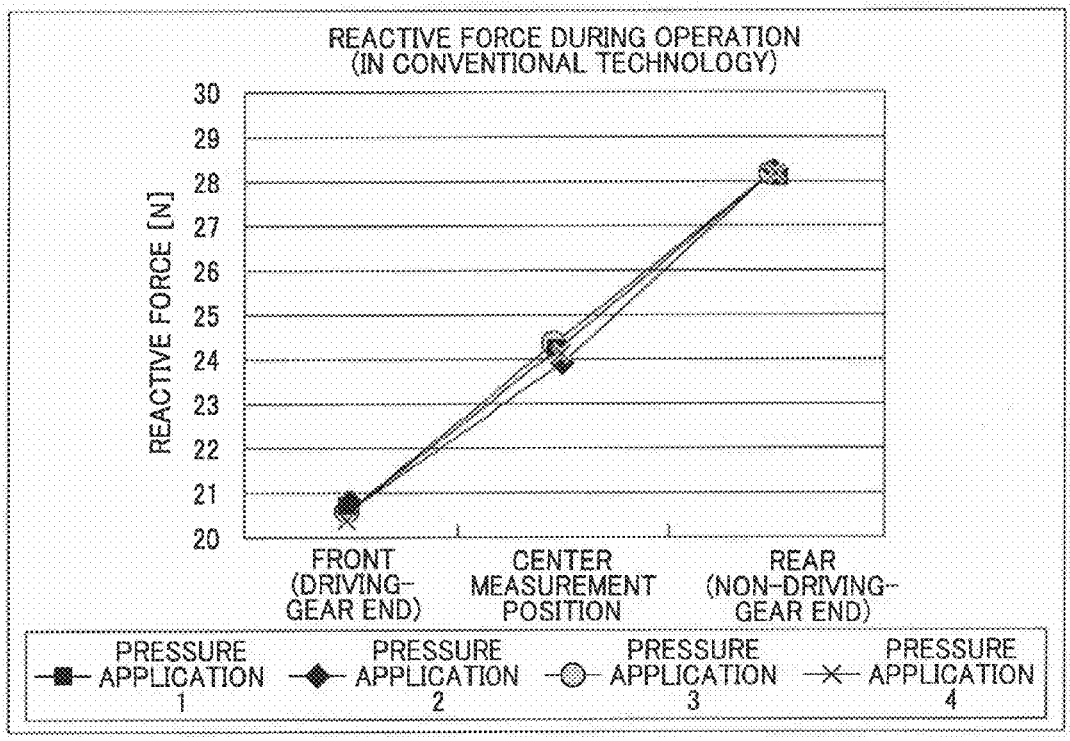
FIG. 5 is a graph of reactive force measurement result in a conventional pressure-applying device.
Figure 6:
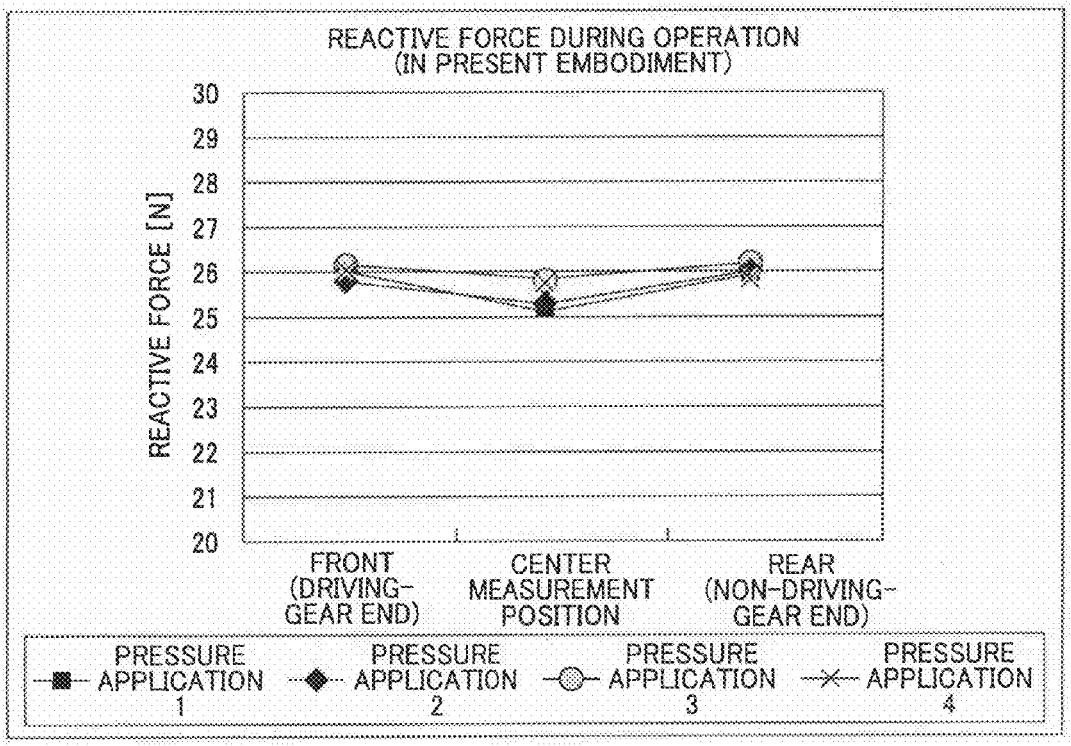
FIG. 6 is a graph of reactive force measurement result in the pressure-applying device according to the first embodiment.
Figure 13:
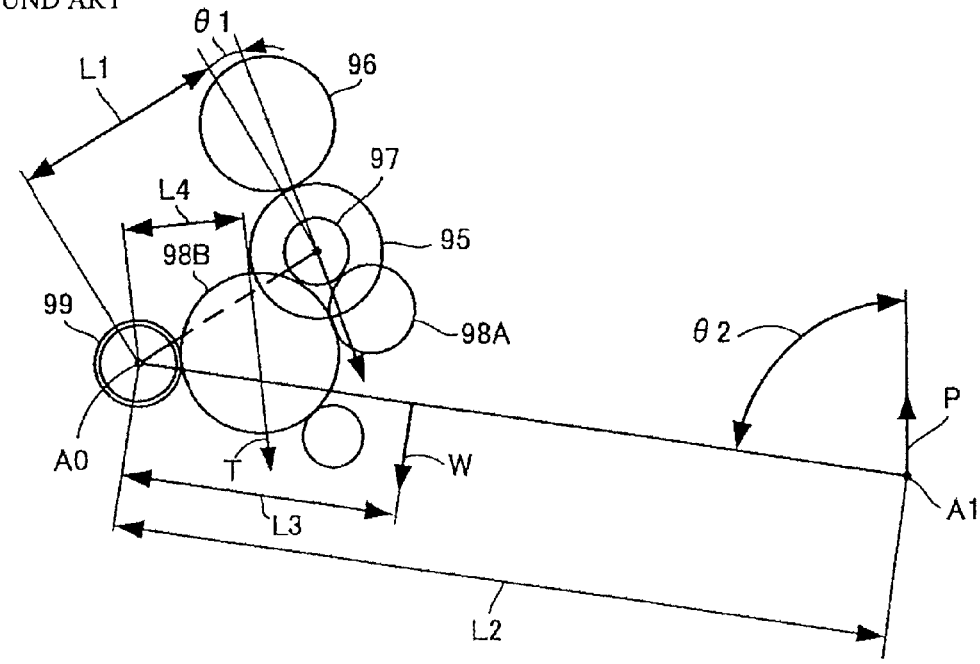
FIG.13 BACKGROUND ART
FIG. 13 is a schematic diagram of a pressure-applying device that employs a conventional drive-force transmission method.

To verify the effect of the present embodiment, reactive force in an axial direction of the secondary transfer roller 25 of the present embodiment shown in FIG. 3 and the secondary transfer roller 95 of the conventional structure shown in FIG. 13 were measured when the respective image forming apparatuses were in operation. The measurement of the reactive force was done at three places on the secondary transfer rollers 25 and 95, namely, the front (driving-gear end), the center, and the rear (non-driving-gear end), repeating pressure application and pressure release four times each. FIG. 5 is a graph of the measurement result in the conventional pressure-applying device and FIG. 6 is a graph of the measurement result in the pressure-applying device according to the present embodiment.

Thus, in the conventional pressure-applying device, the reactive force at the non-driving-gear end is about 7 Newton lower than at the driving-gear end. On the other hand, in the pressure-applying device according to the present embodiment, the difference in the reactive force between driving-gear end and the non-driving-gear end is quite insignificant. In other words, the effect of the driving force T on the reactive force F is minimized in the present embodiment by configuring the pressure-applying device in such a way that the direction in which the driving force T acts substantially coincides with the line (denoted by the reference symbol A7 in FIG. 3) joining the pressure application point (denoted by the reference symbol A5 in FIG. 3) where the pressure application force of the extension coil springs 70 acts and a swinging center (denoted by the reference symbol A6 in FIG. 3) about which the unit body 50 swings. Thus, a transfer device equipped with or acting as a pressure-applying device that maintains constant pressure application force and prevents density unevenness during image transfer, and an image forming apparatus equipped with such a transfer device can be realized.

Figure 7:
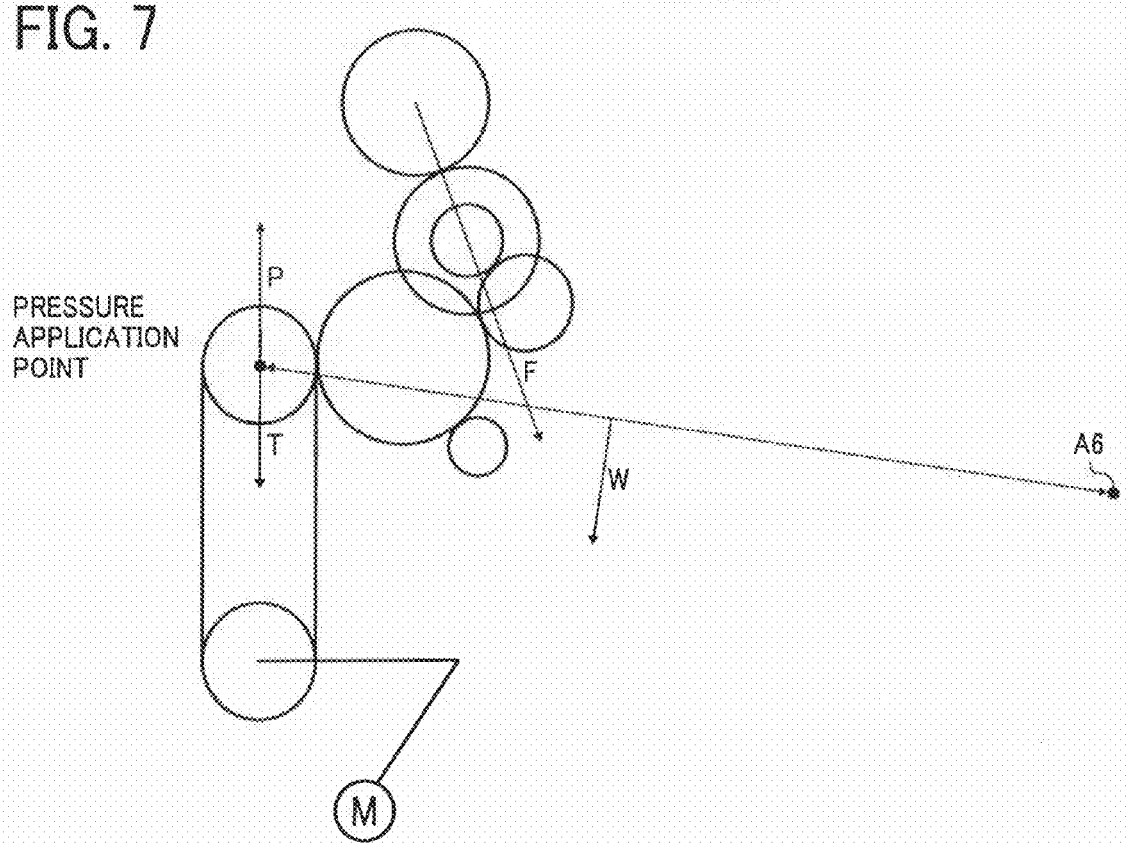
FIG. 7 is a schematic diagram of the pressure-applying device configured such that a direction of pressure application force is parallel to a direction of driving force.

Further, the pressure-applying device according to the present embodiment is configured in such a way that a direction of action of the pressure application force of the extension coil springs 70 is substantially orthogonal to the line A7. As shown in FIG. 7, if the direction of action of the pressure application force of the extension coil springs 70 is parallel to the driving force T, the driving force T will significantly affect the pressure application force P, resulting in causing variation in the reactive force F of the secondary transfer roller 25. Further, the extension coil springs 70 are provided at both ends of the first spindle 57, enabling smooth movement of the first spindle 57 as compared to when the extension coil springs 70 are provided at just one end. Consequently, excellent image formation can be realized.

A pressure-releasing mechanism that acts on the supporting roller 14 of the secondary transfer roller 25 is described below. Pressure is released from the supporting roller 14 of the secondary transfer roller 25 when the unit body 50 supporting the secondary transfer roller 25 moves in the direction indicated by an arrow A8 shown in FIG. 2 about the center of a shaft core of the first spindle 57 that serves as the pressure application point A5. The unit body 50 moves when the cams 68 rotate in the direction of an arrow A9 shown in FIG. 2, so that bias force of the compression springs 66 moves the two ends of the unit body 50 in pressure contact with the cams 68 downwards. Thus, the compression springs 66 function as biasing units, and the cams 68 function as pressure-releasing units. The compression springs 66 and the cams 68 together form a secondary-transfer-unit moving unit 71 which is an example of a unit moving unit.

Thus, by causing the unit body 50 to move about the pressure application point A5 by the mechanism described above, it is possible to prevent occurrence of extension and contraction of the extension coil springs 70 that potentially occur when separating or pressing together the secondary transfer roller 25 and the supporting roller 14 during operations such as maintenance procedures or jam-releasing operation. As a result, the variation in the load of the extension coil springs 70 can be prevented, and load reduction due to hysteresis, that is, reduction in the pressure application force over time, can be prevented.

Based on the principle of moment equilibrium, the spring load of the compression springs 66 is set based on the following expression.

Figure 8:
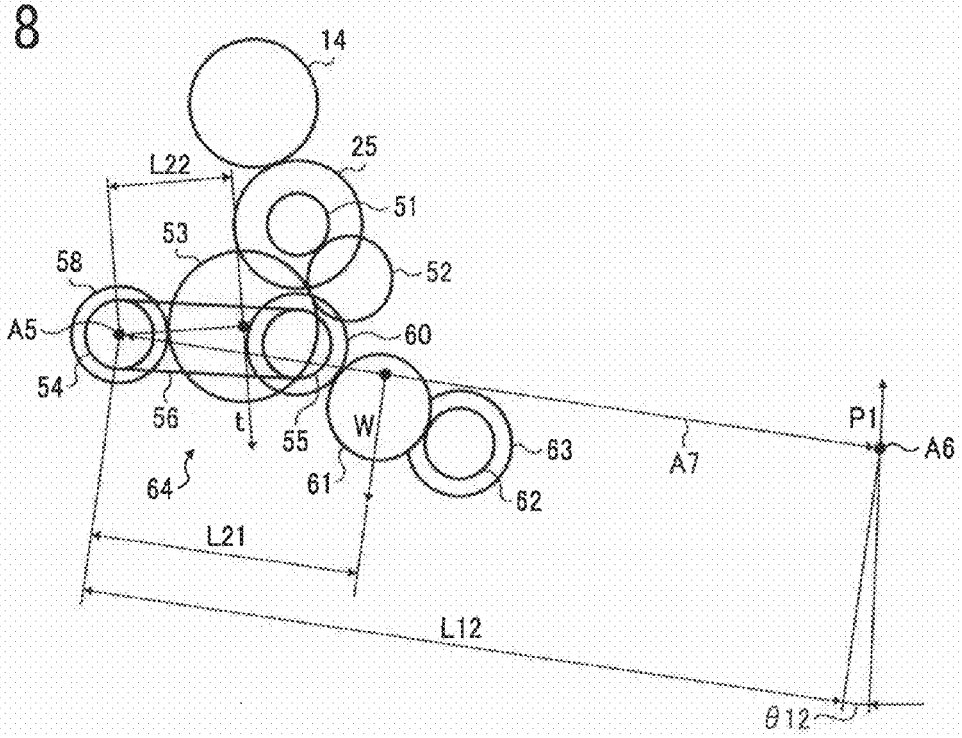
FIG. 8 is a schematic diagram of for explaining a relation between moments that come into play in the first embodiment when a unit body is in operation.

With reference to FIG. 8, assuming that P1 is tension or bias force of the compression springs 66, W is self-weight of the unit body 50, t is driving force transmitted to the next gear from the rotation center, Mα is moment due to the tension P1, and Mβ is moment due to the driving force t, then $$P1\times\cos\theta12=t\times L22+W\times L21$$

$$(M\alpha=P1\times\cos\theta12 \text{ and } M\beta=t\times L22)$$

Thus, the load required for attaining the tension P1 can be given by the following expression, $$P1\geqq(t\times L22+W\times L21)/\cos\theta12$$

In the first embodiment, a design value of the tension P1 is set based on the value calculated using design data (gear ratio and transmission efficiency) of the drive-force transmitting unit 64 at the driving force t when the motor 63 is running at the maximum rated current. The relational expression Mα≧Mβ is achieved due to the configuration of the mechanism, so that it is possible to reduce the effect of the tension P1 of the compression springs 66 on the driving force t when the secondary transfer roller 25 is in operation. Consequently, efficiency of tasks such as maintenance procedures or jam-releasing operation can be improved. In addition, the pressure application force can be maintained constant thus preventing image density unevenness during image transfer and realizing excellent image formation.

The endless belt 56 used in the drive-force transmitting unit 64 in the first embodiment can be completely done away with, and an effect similar to that in the first embodiment can be obtained by using gears alone in the drive-force transmitting unit 64. In a second embodiment of the present invention described below, gears alone form a drive-force transmitting unit.

Figure 9:
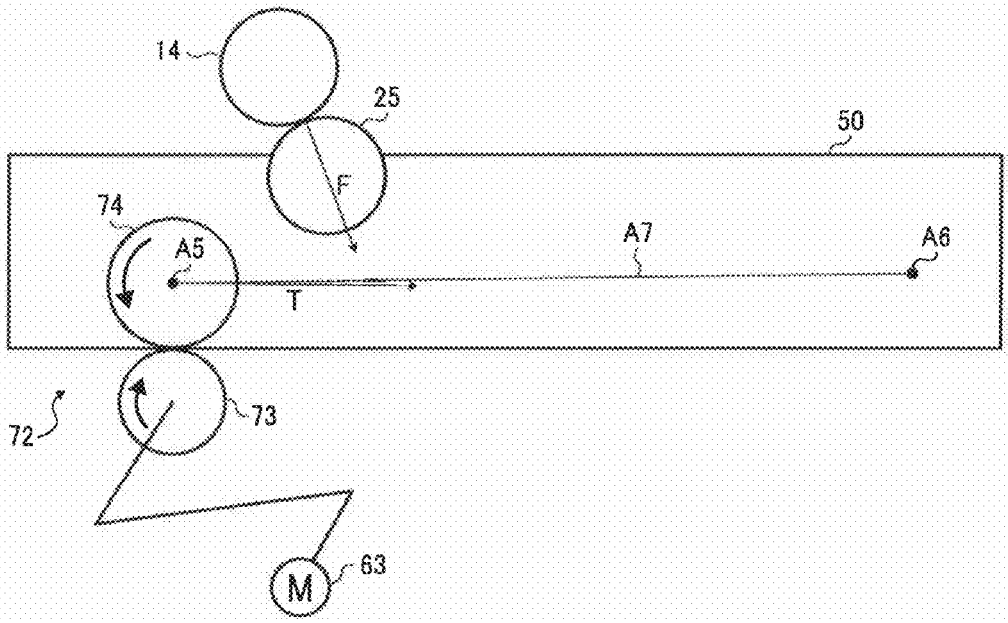
FIG. 9 is a schematic diagram of a pressure-applying device according to a second embodiment of the present invention.

FIG. 9 is a schematic diagram of a drive-force transmitting unit 72 according to the second embodiment. The drive-force transmitting unit 72 includes one gear 73 provided on the apparatus body 3 side and another gear 74 provided on the unit body 50 side. The driving force T from the motor 63 is transmitted to the gear 73 via another gear (not shown) and the driving force T is transmitted to the unit body 50 via the gear 74. The positional relation between the gears 73 and 74, the pressure application point A5, and the swinging center A6 of the unit body 50 are kept such that a direction of action of the driving force T substantially coincides with a line A7 joining the pressure application point A5 and the swinging center A6. Consequently, the effect achieved is similar to that in the first embodiment. In the second embodiment, the direction of action of the pressure application force of the extension coil springs 70 is substantially orthogonal to the line A7, and hence, the driving force does not have any effect on the pressure application force. In the drive-force transmitting unit 72 without the endless belt 56, the gear 73 is provided on the apparatus body 3 side, and the gear 74 provided on the unit body 50 side moves as the unit body 50 moves. Therefore, it is necessary to provide a joining member between the gears 73 and 74.

Figure 10:
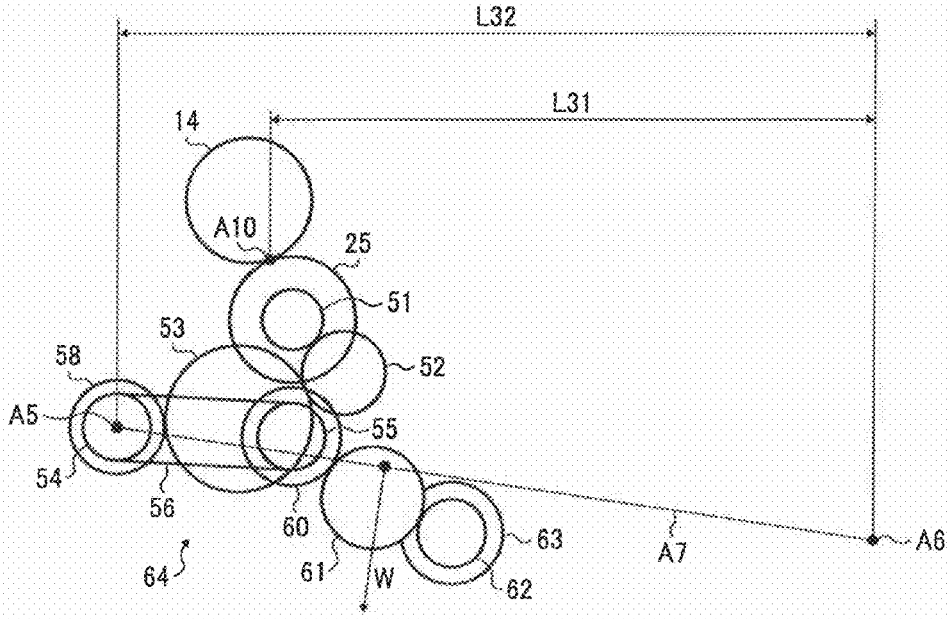
FIG. 10 is a schematic diagram for explaining a relation between a horizontal distance between a contact point of the roller and an opposing member and a swinging center and a horizontal distance between a pressure application point and the swinging center according to the second embodiment.
Figure 11:
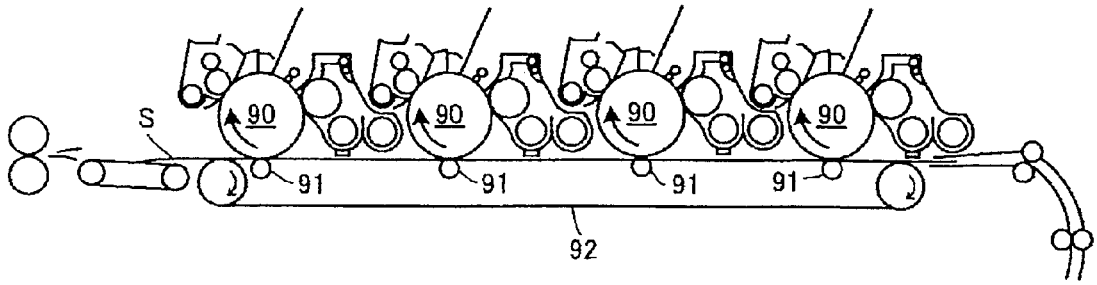
BACKGROUND ART FIG.11
FIG. 11 is a schematic diagram of a conventional image forming apparatus of direct transfer type.
Figure 12:
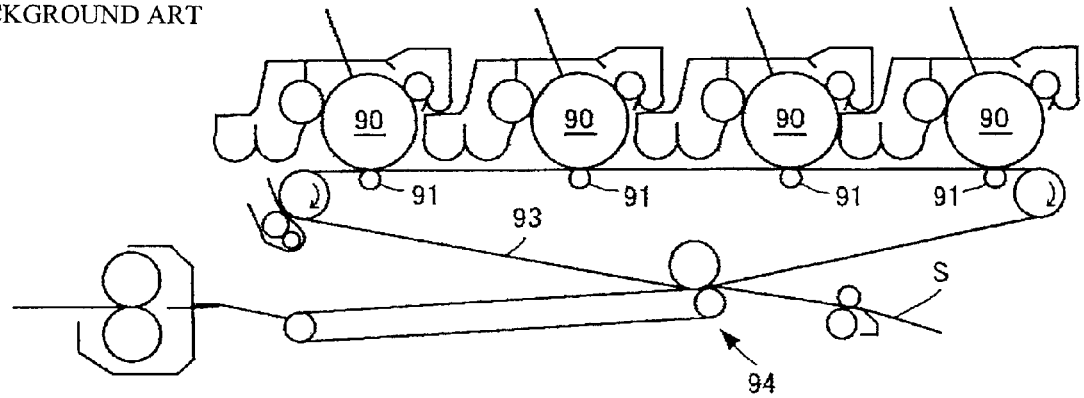
FIG.12 BACKGROUND ART
FIG. 12 is a schematic diagram of a conventional image forming apparatus of intermediate transfer type.

In the first and the second embodiments, as shown in FIG. 10, a horizontal distance L31 between a contact point A10 of the supporting roller 14 and the secondary transfer roller 25 and the swinging center A6 is set shorter than a horizontal distance L32 between the pressure application point A5 and the swinging center A6. By this configuration, a relatively small spring load is sufficient to realize the pressure application force required for the secondary transfer roller 25 to come in pressure contact with the supporting roller 14. Consequently, a spring constant of the extension coil springs 70 can be reduced. As a result, deformation of the extension coil springs 70 can be reduced, and therefore, the effect of the deformation on the pressure application force can be reduced.

In the first and the second embodiments, the supporting roller 14 is employed as the opposing member in pressure contact with the secondary transfer roller 25 across the transfer belt 4. However, the opposing member can be a roller member or a photosensitive drum in direct pressure contact with the secondary transfer roller 25. A tandem-type color copier is described as the image forming apparatus 1 in the first and the second embodiments. However, the present invention can be adapted to any image forming apparatuses such as printers, facsimile machines, plotters, and multi-function peripherals.

According to an aspect of the present invention, the direction of action of driving force is made to substantially coincide with a line joining a pressure application point where the pressure application force of a pressure-applying unit acts and a swinging center of a unit body. Consequently, a pressure-applying device, a transfer device equipped with or acting as the pressure-applying device, and an image forming apparatus equipped with such a transfer device is realized that can maintain unvarying pressure application force. As a result, it is possible to prevent density unevenness during image transfer, realizing excellent image formation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A pressure-applying device for use in an apparatus, the pressure-applying device comprising:

a unit body swingably supported by an apparatus body;

a roller rotatably supported by the unit body;

a driving unit that applies driving force via a drive-force transmitting unit to rotate the roller;

an opposing member arranged opposite to the roller, the roller and the opposing member being configured to have a transfer belt and a transfer sheet pass between the roller and the opposing member such that a transfer point is formed between the roller and the opposing member where an image is transferred from the transfer belt to the transfer sheet; and a pressure-applying unit that applies a bias force that causes the unit body to swing and applies pressure application force that causes the roller to come in pressure contact with the opposing member, wherein a swinging center of the unit body is set at a position distinct from the drive-force transmitting unit, a direction of action of the driving force substantially coincides with a line joining the swinging center and a pressure application point at which the pressure application force is applied, and a direction of action of the pressure application force is substantially orthogonal to the direction of action of the driving force.

2. The pressure-applying device according to claim 1, wherein the drive-force transmitting unit includes an endless belt, and a direction of action of tension of the endless belt substantially coincides with the line joining the pressure application point and the swinging center.

3. The pressure-applying device according to claim 2, wherein the drive-force transmitting unit further includes a first pulley and a second pulley that support the endless belt, the pressure application point is located at a first rotation center of the first pulley, and a swing locus of the unit body approximates an arc about a second rotation center of the second pulley, the arc passing through the first rotation center.

4. The pressure-applying device according to claim 1, wherein the drive-force transmitting unit includes gears, and a direction of action of driving force of the gears substantially coincides with the line joining the pressure application point and the swinging center.

5. The pressure-applying device according to claim 1, wherein the unit body is movably set in the apparatus body so that the roller can be either at a pressure-contact position where the roller is in pressure contact with the opposing member or at a disjunctive position where the roller is away from the opposing member.

6. The pressure-applying device according to claim 5, further comprising a unit-moving unit that moves the unit body and is arranged in vicinity of the swinging center, wherein a rotation center of the unit body is positioned at the pressure application point.

7. The pressure-applying device according to claim 6, wherein the unit-moving unit includes a biasing unit that biases the unit body so that the roller is at the pressure-contact position, and a releasing unit that releases bias force of the biasing unit so that the roller is at the disjunctive position.

8. The pressure-applying device according to claim 7, a first moment is set to be greater than a second moment, the first moment being a moment due to the bias force of the biasing unit and the second moment being a moment due to the driving force of the drive-force transmitting unit.

9. The pressure-applying device according to claim 1, wherein a first horizontal distance is set shorter than a second horizontal distance, the first horizontal distance being a distance between a contact point of the roller and the opposing member and the swinging center, and the second distance being a distance between the pressure application point and the swinging center.

10. A transfer device comprising a pressure-applying device that includes a unit body swingably supported by an apparatus body;

a roller rotatably supported by the unit body;

a driving unit that applies driving force via a drive-force transmitting unit to rotate the roller;

an opposing member arranged opposite to the roller, the roller and the opposing member being configured to have a transfer belt and a transfer sheet pass between the roller and the opposing member such that a transfer point is formed between the roller and the opposing member where an image is transferred from the transfer belt to the transfer sheet; and a pressure-applying unit that applies a bias force that causes the unit body to swing and applies a pressure application force that causes the roller to come in pressure contact with the opposing member, wherein a swinging center of the unit body is set at a position distinct from the drive-force transmitting unit, a direction of action of the driving force substantially coincides with a line joining the swinging center and a pressure application point at which the pressure application force is applied, and a direction of action of the pressure application force is substantially orthogonal to the direction of action of the driving force.

11. An image forming apparatus comprising:

a pressure-applying device that includes a unit body swingably supported by an apparatus body;

a roller rotatably supported by the unit body;

a driving unit that applies driving force via a drive-force transmitting unit to rotate the roller;

an opposing member arranged opposite to the roller, the roller and the opposing member being configured to have a transfer belt and a transfer sheet pass between the roller and the opposing member such that a transfer point is formed between the roller and the opposing member where an image is transferred from the transfer belt to the transfer sheet; and a pressure-applying unit that applies a bias force that causes the unit body to swing and applies a pressure application force that causes the roller to come in pressure contact with the opposing member, wherein a swinging center of the unit body is set at a position distinct from the drive-force transmitting unit, a direction of action of the driving force substantially coincides with a line joining the swinging center and a pressure application point at which the pressure application force is applied, and a direction of action of the pressure application force is substantially orthogonal to the direction of action of the driving force.

* * * * *